United States Patent [19]

Ricciardi

[11] 4,154,372

[45] May 15, 1979

[54] VOLUMETRIC DRY MATERIALS FEEDER

[76] Inventor: Ronald J. Ricciardi, 108 Malcolm Ave., Garfield, N.J. 07026

[21] Appl. No.: 816,653

[22] Filed: Jul. 18, 1977

[51] Int. Cl.[2] ..... B01F 7/04; B01F 7/08

[52] U.S. Cl. ..... 222/238; 222/241; 366/295; 366/300; 366/319; 366/320; 366/321

[58] Field of Search ..... 366/295, 300, 297, 319, 366/320, 321; 222/238, 239, 240, 241, 271, 412, 413

[56] References Cited

U.S. PATENT DOCUMENTS

| | | | |
|---|---|---|---|
| 36,633 | 10/1862 | Witsil | 366/297 |
| 2,554,769 | 5/1951 | Arnold | 366/319 |
| 3,186,602 | 6/1965 | Ricciardi | 222/241 X |
| 3,377,000 | 4/1968 | Mason, Jr. | 366/319 X |
| 3,439,836 | 4/1969 | Ricciardi | 222/240 |
| 3,992,985 | 11/1976 | McFarland | 366/300 X |

*Primary Examiner*—David A. Scherbel

*Attorney, Agent, or Firm*—Edwin T. Grimes

[57] ABSTRACT

The invention is directed to apparatus for conditioning and dispensing particulate solid material which includes a conditioning chamber having an upper receiving inlet and a dispensing outlet, a first auger disposed within the chamber and extending towards the outlet and having a helical blade for propelling material towards the outlet in response to rotation thereof, a second larger open spiral auger mounted coaxially with respect to the first auger for feeding the material into the first auger in response to rotation of the second auger, the second auger being disposed concentrically and in overlapping relationship with respect to the first auger, a third open spiral auger mounted in side-by-side parallel relationship with respect to the second auger, the third auger being of substantially the same diameter as the second auger, and a driving mechanism for rotating the three augers at a predetermined ratio of speeds one with respect to the others.

10 Claims, 4 Drawing Figures

VOLUMETRIC DRY MATERIALS FEEDER

BACKGROUND OF THE INVENTION

This invention relates to feeding apparatus and more particularly to a combination of an integral bin discharging mechanism and a volumetric metering device. The apparatus embodying the present concept is particularly adapted, among other possible uses, for promoting product flow and to subsequently feed even the most difficult to handle dry ingredients. It is especially effective for handling many varieties of difficult to handle additives used in the plastics, foods, chemicals and the like industries, particularly at the lower feed rates.

Feeding apparatus such as that shown in my U.S. Pat. Nos. Des 228,950 and Des 228,951 are particularly adapted for large installations, wherein the units are intended for direct flange attachment to the bottom of a large bin or silo. The feeding augers shown and described in my U.S. Pat. Nos. 3,186,602 and 3,439,836 are particularly directed to material control and reliably accurate volumetric metering, particularly in the lower volumetric range. The present application is directed to a new combination of elements combined in such a manner as to be particularly applicable to a medium volumetric range such as, for example, from about 0.002 cu. ft./hr. up to about 50 cu ft./hr.

SUMMARY OF THE INVENTION

In view of the foregoing, my invention contemplates the provision of a new and improved apparatus for conditioning and dispensing particulate solid material characterized by a conditioning chamber having an upper receiving inlet and a dispensing outlet. A first auger is disposed within the chamber and extends towards the outlet and typically has a helical blade for propelling the material towards the outlet in response to rotation thereof. A second larger open spiral auger is mounted coaxially with respect to the first auger for feeding the material into the first auger in response to rotation thereof. The second auger is disposed concentrically and in overlapping relationship with respect to the first auger. In one form of the invention, the second auger has a portion thereof with reverse pitch with respect to the pitch of the first auger for creating a counter-current movement of the material in the chamber to the direction imparted to it by the first auger. According to the invention, a third open spiral auger is mounted in side-by-side parallel relationship with respect to the second auger. The third auger is of substantially the same diameter as the second auger. In one form of the invention, the third auger has a portion thereof with one pitch and another portion with the opposite pitch so that adjacent portions of the second and third augers have reversed pitch with respect to each other. Further, according to the invention, means are provided for rotating the three augers at a predetermined ratio of speeds one with respect to the others. In one form of the invention, the first and second augers are rotated in one direction and the third auger is rotated in the opposite direction.

According to one aspect of the invention, the second and third augers are mounted in a cantalever-like manner. According to another aspect, the dispensing outlet includes a discharge conduit disposed ourwardly of the chamber, and the first auger extends at least a substantial distance into said conduit.

A feature of the invention resides in the fact that the augers are so rotated that the material is conveyed inwardly and downwardly towards the central portion of the chamber between the second and third augers and upwardly along the side perimeters of the chamber adjacent the second and third augers, respectively.

As another aspect of the invention, the means for rotating the augers includes gearing means and a single motor for driving all three augers.

In one form of the invention, the second and third augers are each provided with a plurality of paddles mounted on their peripheries for increasing the agitation of the material in the conditioning chamber.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the purposes of the invention. It is important, therefore, that the claims be regarded as including equivalent methods and apparatus as do not depart from the spirit and scope of the invention.

Specific embodiments of the invention have been chosen for purposes of illustration and description, and are shown in the accompanying drawings, forming a part of the specification.

DETAILED DESCRIPTION OF THE PREFERRED EMBODIMENTS

Figure 1:
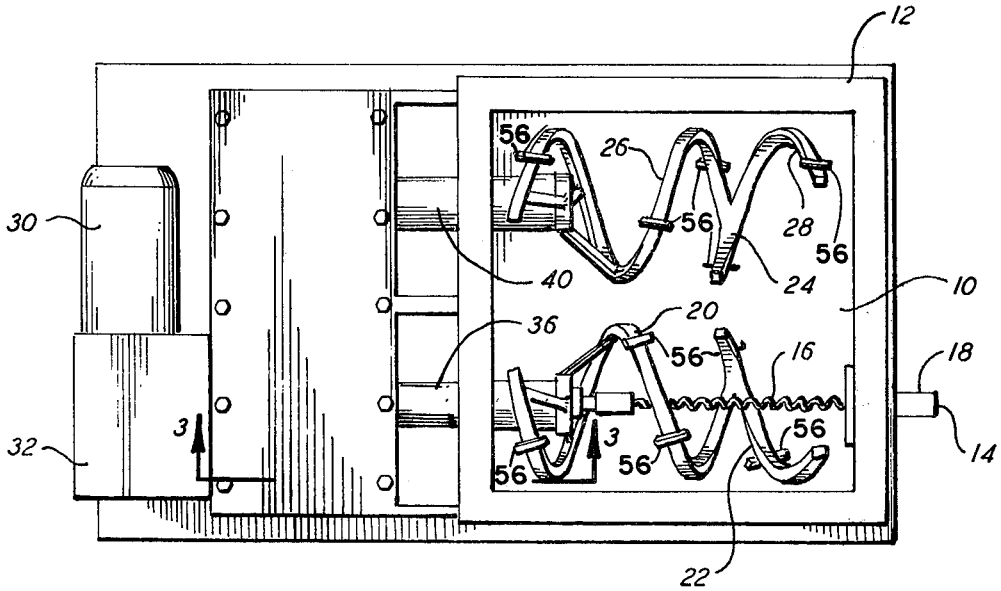
FIG. 1 is a plan view, partially broken away, of an apparatus for conditioning and dispensing particulated solid material constructed according to the concepts of the invention.
Figure 2:
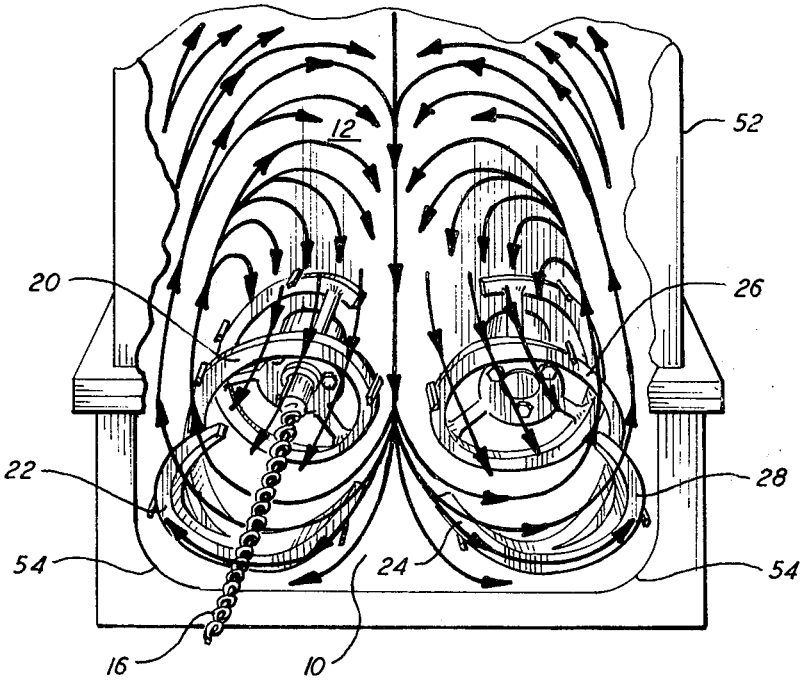
FIG. 2 is perspective view of the apparatus of FIG. 1 showing the movement of the material being processed in the apparatus.

In the embodiments of the invention illustrated in FIGS. 1 and 2, the apparatus for conditioning and dispensing particulate solid material comprises a conditioning chamber 10 having an upper material inlet 12 and a dispensing outlet 14. A first auger 16 is mounted in the chamber and extends towards the outlet, passing substantially through an outlet conduit 18. This outlet conduit provides at least some support for the outlet end of the first auger. The first auger 16 typically has a helical blade for propelling the material towards said outlet in response to rotation thereof.

A second larger open spiral auger 20 is mounted coaxially with respect to the first auger for feeding the material into the first auger in response to rotation of the second auger. The second auger is disposed concentrically and in overlapping relationship with respect to the first auger. The second auger has a portion thereof 22 with reverse pitch with respect to the pitch of the first auger for creating a counter-current movement of the material in the chamber 10 with respect to the direction imparted to it by the first auger.

A third open spiral auger 24 is mounted in side-by-side parallel relationship with respect to the second auger 20. The third auger 24 is of substantially the same diameter as the second auger and has a portion thereof 26 with one pitch and another portion thereof 28 with the opposite pitch so that adjacent portions of the second and third augers have reversed pitch with respect to each other.

Figure 4:
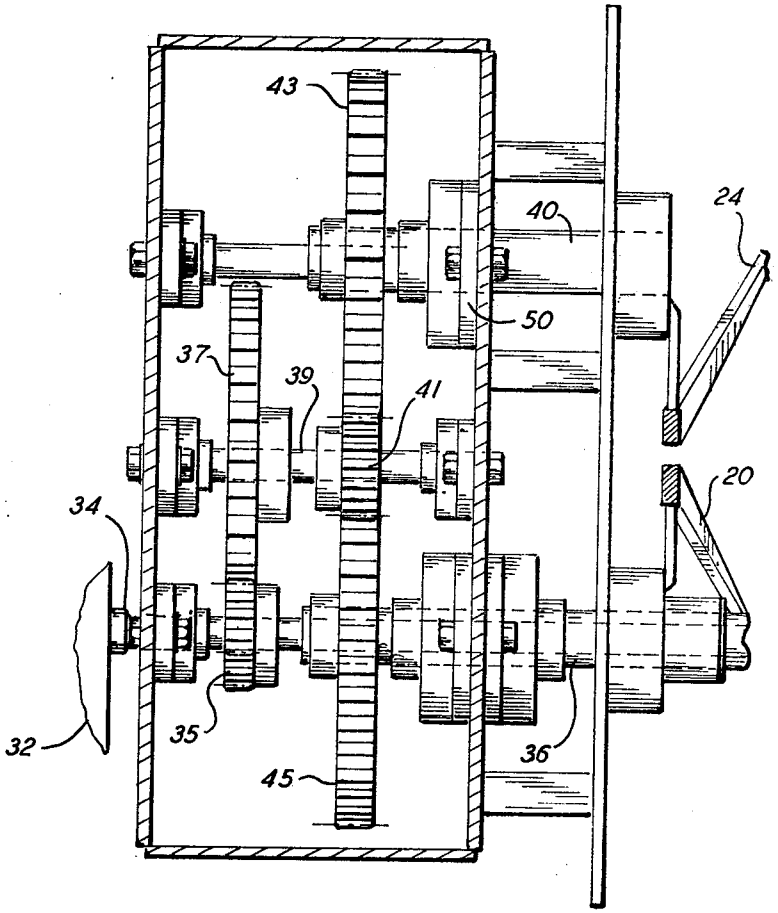
FIG. 4 is an enlarged sectional view taken along the line indicated at 4—4 in FIG. 3.
Figure 3:
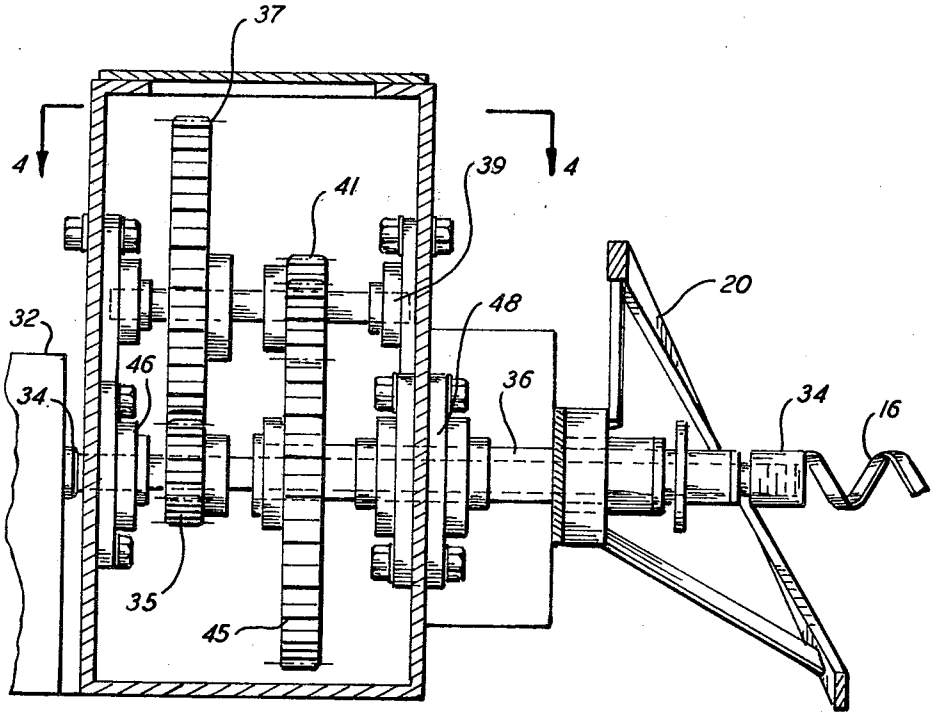
FIG. 3 is an enlarged sectional view taken along the line indicated at 3—3 in FIG. 1, showing the drive means for the augers.

Means are provided for rotating the first and second augers 16, 20 in one direction and for rotating the third auger 24 in the opposite direction, which include a D.C. motor 30 that drives a gear reducer 32. As best seen in FIGS. 3 and 4, the gear reducer 32 drives a first drive shaft 34 connected to the first auger 16, and, through a gear 35 affixed on the drive shaft 34, drives a gear 37 mounted on a medial upper countershaft 39. In turn, a gear 41 mounted on the countershaft 39 drives a gear 45 mounted on a second (concentric) drive shaft 36 for driving the second auger 20. The gear 45 also drives a gear 43 mounted on a third drive shaft 40 for driving the third auger 24. Thus, gear 41 drives the gears 43 and 45 at the same speeds, but in opposite directions. It is noted that the three drive shafts, as well as the countershaft, are disposed in parallel relationship with respect to each other. It will be appreciated that all three augers are geared together in a precision assembly with their speed controlled by the single D.C. motor. The ratio of speeds between the augers is determined by the specific handling characteristics of the material in conjunction with the density and output rate of the ingredient or ingredients being metered. Normally, the second and third augers are rotated in opposite directions at the same speed and the first auger is rotated in the same direction as the second auger, but at a greater rate of speed.

Conventional bearing means are provided for the auger drive shafts, the first drive shaft 34 being supported at 46, the second (concentric) drive shaft 36 at 48 and the third drive shaft 40 at 50. It is noted that the second and third augers are mounted in a cantalever-like manner, as there is no need for support of the outer end.

In some installations, it is desirable to mount an integral hopper 52, FIG. 2, at the upper receiving inlet 12 of the conditioning chamber 10 for supplying said chamber.

As best seen in FIG. 2, the conditioning chamber 10 is of substantially rectangular configuration with the augers being disposed substantially parallel to the sidewalls thereof. The chamber is provided with rounded sidewall-bottom edges 54. As can be seen in FIG. 2, the second and third augers 20, 24 each encompass approximately one-half of the body of the conditioning chamber. These augers generate internal forces which maintain a "live" mass of material within the feeder. In operation, as indicated by the arrows in FIG. 2, the second and third augers 20, 24 convey the material inwardly and downwardly towards the central portion of the chamber. In turn, this action generates upward forces along the side perimeters of the chamber resulting in substantial internal rotational agitation which ensures positive flow. Subsequently, with hoppering assured, the interauger action of the concentrically disposed first and second augers 16, 20 provides a very high degree of metering performance.

In some installations it is desirable to increase the agitation in the conditioning chamber 10 by mounting small bars or paddles 56 on the peripheries of the second and third augers 20 and 24, respectively.

From the foregoing description, it will be appreciated that the present invention contributes a new and improved apparatus for agitating, conditioning and thence metering particulate solid material.

Although several particular embodiments of the invention are herein disclosed for purposes of explanation, modification thereof after study of this specification, will be apparent to those skilled in the art to which the invention pertains. Reference should be had to the appended claims in determining the scope of the invention.

What is claimed and desired to be secured by Letters Patent is:

1. Apparatus for conditioning and dispensing particulate solid material comprising a conditioning chamber having an upper receiving inlet and a dispensing outlet, a first auger horizontally disposed within said chamber and extending towards said outlet and having helical blade for propelling said material towards said outlet in response to rotation of the auger, a second larger open spiral auger mounted coaxially with respect to said first auger for conditioning and feeding said material into said first auger in response to rotation of the second auger, said second auger being disposed concentrically and in overlapping relationship with respect to said first auger, a third open spiral auger mounted in side-by-side parallel relationship with respect to the second auger, said third auger being of substantially the same diameter as said second auger, said upper receiving inlet extending over an area so that said particulate solid material directly flows into said second and third augers substantially along their entire length, and means for rotating said augers at predetermined ratio of speeds one with respect to the others, said means for rotating said augers rotates said first and second augers in one direction and said third augers in the opposite direction, said second and third augers being mounted in said conditioning chamber in a cantalever-like manner, respectively, whereby said apparatus is particularly applicable to conditioning and dispensing a medium volumetric range of particulate solid material from about 0.002 cubic-feet per hour to about 50 cubic-feet per hour.

2. Apparatus for conditioning and dispensing particulate solid material comprising a conditioning chamber having an upper receiving inlet and a dispensing outlet, a first auger disposed within said chamber and extending towards said outlet and having a helical blade for propelling said material towards said outlet in response to rotation of the auger, a second larger open spiral auger mounted coaxially with respect to said first auger for conditioning and feeding said material into said first auger in response to rotation of the second auger, said second auger being disposed concentrically and in overlapping relationship with respect to said first auger, said second auger having a portion thereof with reversed pitch with respect to the pitch of said first auger for creating a counter-current movement of the material in the chamber with respect to the direction imparted to it by the first auger, a third open spiral auger mounted in side-by-side parallel relationship with respect to the second auger, said third auger being of substantially the same diameter as said second auger, said third auger having a portion thereof with one pitch and a portion thereof with the opposite pitch so that adjacent portions of the second and third augers have reversed pitch with respect to each other, means for rotating said first and second augers in one direction and for rotating said third auger in the opposite direction.

3. Apparatus for conditioning and dispensing particulate solid material according to claim 2 wherein said dispensing outlet includes a discharge conduit disposed outwardly of said chamber, and said first auger extends at least a substantial distance into said conduit.

4. Apparatus for conditioning and dispensing particulate solid material according to claim 2 wherein said means for rotating said augers rotates the augers so that material is conveyed inwardly and downwardly towards the central portion of the chamber between the second and third augers and upwardly along the side perimeters of the chamber adjacent the second and third augers, respectively.

5. Apparatus for conditioning and dispensing particulate solid material according to claim 2 wherein said means for rotating said augers includes gearing means and a single motor for driving all three augers.

6. Apparatus for conditioning and dispensing particulate solid material according to claim 5 wherein said augers are driven at a predetermined ratio of speeds.

7. Apparatus for conditioning and dispensing particulate solid material according to claim 2 wherein said second and third augers each have a plurality of paddles mounted on their peripheries.

8. Apparatus for conditioning and dispensing particulate solid material according to claim 2 further comprising an integral hopper provided at the upper receiving inlet of said conditioning chamber.

9. Apparatus for conditioning and dispensing particulate solid material according to claim 2 wherein said chamber is of substantially rectangular configuration with said augers being disposed substantially parallel to the sidewalls thereof.

10. Apparatus for conditioning and dispensing particulate solid material according to claim 2 wherein said means for rotating said augers comprises a motor, a gear reducer means driven by said motor, a first drive shaft connected to the first auger driven by said gear reducer means, a countershaft having a gear fixedly mounted therein which is driven by a gear on said first drive shaft, a second drive shaft disposed concentrically with respect to the first drive shaft for carrying said second auger, a third drive shaft connected to said third auger, a gear fixedly mounted on the countershaft for driving a gear fixedly mounted on the second drive shaft in one direction and for driving a gear fixedly mounted on the third drive shaft in the opposite direction, and said shafts being disposed in parallel relationship one with respect to the others.

* * * * *